United States Patent [19]

Allison et al.

[11] Patent Number: 4,675,924

[45] Date of Patent: Jun. 30, 1987

[54] EMERGENCY EYE WASH FOUNTAIN

[76] Inventors: Gary D. Allison; Michele Allison, both of 13650 Santa Ysabel, Desert Hot Springs, Calif. 92240

[21] Appl. No.: 836,726

[22] Filed: Mar. 6, 1986

[51] Int. Cl.[4] ..... A61H 33/00; A61H 33/04

[52] U.S. Cl. ..... 4/620; 4/615; 4/619; 128/66; 604/294; 604/300

[58] Field of Search ..... 4/620, 619, 615, 624, 4/625, 661; 239/332, 24, 25, 28, 29, 543, 590.3, 30, 29.3; 128/66; 604/296, 294, 297, 301, 302, 300

[56] References Cited

U.S. PATENT DOCUMENTS

| | | | |
|---|---|---|---|
| 3,090,050 | 5/1963 | Fraser et al. | 4/620 |
| 3,413,660 | 12/1968 | Lagarelli et al. | 4/620 |
| 3,599,251 | 8/1971 | Wright | 4/620 |
| 3,629,876 | 12/1971 | Wright | 4/620 |
| 3,809,315 | 5/1974 | Wright | 4/620 X |
| 3,928,829 | 12/1975 | Bost | 4/615 |
| 4,012,798 | 3/1977 | Liautaud | 4/620 |

*Primary Examiner*—Henry K. Artis

*Attorney, Agent, or Firm*—I. Louis Wolk

[57] ABSTRACT

An eye wash fountain device in which eye and face wash nozzles are attached to a unit which is separate from and removably attached to a sleeve or conduit on an adapter for attachment to water supply, said adapter being provided with a valve means to divert normal water flow to said sleeve or conduit and to said nozzles. The nozzles are provided with a special type of perforated disc which serves to modify and control the spray obtained.

5 Claims, 6 Drawing Figures

FIG 5.A.

EMERGENCY EYE WASH FOUNTAIN

BACKGROUND OF THE INVENTION

This invention relates to an emergency eye and face wash fountain assembly which can be attached to a conventional sink faucet. Such fountains which comprise a pair of flushing nozzles are in common use in laboratories and factories, and any work areas where there is any risk or eye and/or face damage due to the presence of corrosive or irritating materials. Wash fountains are usually legal requirements for employee safety in such establishments.

Various types of eye fountains are known and in common use. For example, an attachable apparatus is described in U.S. Pat. No. 3,925,829. Separate fountains with integral spray nozzles are shown in U.S. Pat. Nos. 3,599,251, 3,629,876 and 3,413,660.

SUMMARY OF THE INVENTION

In accordance with the present invention an assembly is provided which permits almost any sink faucet to be converted to an eye wash station in a very simple manner without interfering with normal faucet operation.

As described below a pair of eye wash nozzles are mounted upon a unit which is separate from and removably attached to a conduit on an adapter which comprises a valve body which permits normal water flow through inlet and exit means when attached to a sink fauoet or other water supply.

A valve member positioned within said adapter can quickly divert water flow into the conduit to which the eye wash nozzle unit is attached. The provision of a separable and separable unit for the eyewash nozzles permits application to and removal from the water supply without the necessity of removing the adapter which can remain in place permanently if so desired. The nozzle unit can then be cleaned and stored for use when desired or may remain in attached position.

As further described herein a valve body is provided with a threaded inlet attachable to a stanuard faucet. The valve body is provided with a pullout knob which is spring loaded to keep a valve in closed position during normal water flow but when pulled out during water flow the flow is diverted to a separate conduit to which a spray nozzle assembly is removably attached as described further below. When the pullout knob is activated while the water flow is on, water pressure holds the spring loaded valve open leaving the hands free, and the water flows into a pair of spaced apart anti-splash aerator type nozzles angled toward the face. When the pullout knob is pushed in or the water flows shut off this faucet reverts to normal operation. The nozzles themselves are provided with a novel water flow distributing member in the form of a disc having a plurality of openings arranged in a desired manner, said disc being positioned within the nozzle and spaced from the nozzle out whereby the nature and height of the spray obtained are modified to provide optimum comfort and effect.

BRIEF DESCRIPTION OF THE DRAWING

In the drawing:

FIG. 5*a* is an enlarged view in outline illustrating the disc of FIG. 5.

DESCRIPTION OF THE PREFERRED EMBODIMENTS

Figures 1, 2, 3, 4, 5:
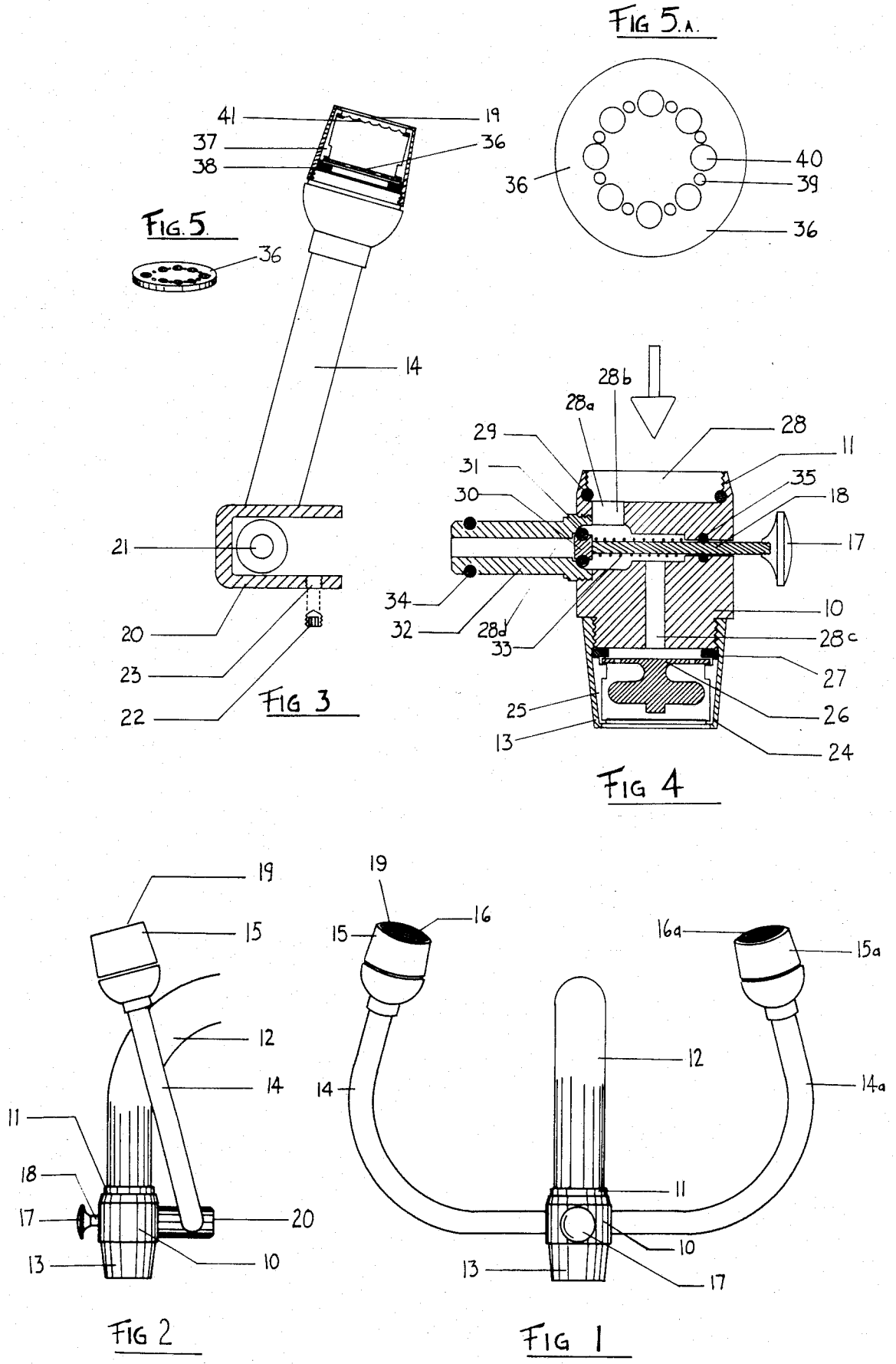
FIG. 1 is a front view in perspective of the assembly mounted upon a faucet.
FIG. 2 is a side view in perspective of the assembly of FIG. 1.
FIG. 3 is a view partially in cross section showing a side view of a nozzle tube attached to a sleeve member as it is positioned for attachment to the eye wash conduit shown in FIG. 4.
FIG. 4 is a view in vertical transverse cross section of the valve body and nozzle attachment structure which is designed to be attached to a faucet together with a view in cross section one of the nozzles.
FIG. 5 is a view in perspective of a spray control disc to be positioned within each nozzle.

Referring now to FIGS. 1 and 2 which show front and side elevational views of the assembled device, valve body 10 is shown with its vertically threaded end 11 attached to faucet 12 and with its normal water flow outlet 13. A pair of tubular arms 14 and 14*a* having nozzles 15 and 15*a* with aerating screens 16 and 16*a* at the ends thereof are attached to opposite sides of sleeve 20 which is designed to fit over and be attached to a conduit mounted upon the valve body as described below with reference to FIGS. 3 and 4. Tubes 15 and 15*a* are suitably contoured to provide a desired degree of spacing between the nozzles, say 5 inches.

Water flow to the nozzles is controlled by means of a pullout knob 17 mounted on shaft 18, and as described further below when knob 17 is pulled out water flow is diverted from the faucet to the nozzles and the spray exits through the openings thereof as shown at 19.

In FIG. 3, tube 14 with nozzle 15 is shown attached at one side to sleeve 20 by welding or soldering threads, (also shown in FIG. 2) said tube communicating with the interior of the sleeve as shown at 21. The sleeve is designed to snugly slide over and be affixed to a corresponding male conduit on the valve body as described with reference to FIG. 4 and secured by means of a set screw 22 which is screwed into threaded opening 23 upon attachment as described below. In so attaching the sleeve it is positioned over conduit 32 of FIG. 4 for a distance such that water flow into tube opening 21 is unrestricted.

As shown in FIG. 4, valve body 10 is shown with its threaded water inlet opening 11 attachable to a faucet. The normal water outlet 13 may be provided with a flow distributor in the form of a housing 24 attached by threads to the valve body and containing if desired a conventional perforated water flow distributng member 26 supported within a plastic sleeve 25 and provided with a gasket 27. The direction of water flow is shown by the arrow.

The valve body as shown is provided with a water inlet, gasket 29, 28 and water flow channels or chambers 28*a*, 28*b* and 28*c* through which water flows when the faucet is used for normal flow. Chamber 28*b* is provided with a valve hood 30 having an "O" ring 31 thereon designed to seat against the interior of chamber 28*b* against the opening to 32 to normally close off channel 28*d*, as shown. The valve member is attached to valve stem 18 which is surrounded by an open spring 33 which urges the valve into closed position to permit normal water flow through channels 28*a*, 28*b* and 28*c*. When knob 17 is pulled out spring 33 is compressed and valve 30 is then opened to permit waterflow through 28, 28*a*, 28*b*, and then through channel 28*d* into conduit 32. This permits the water to flow from channel 28*d* into tube 14 through opening 21 as shown in FIG. 3 and similarly into tube 14*a* mounted upon the opposite side of sleeve 20. The valve spring tension is designed to permit the valve to remain in open position under water pressure during water flow when the knob is pulled out and continues to flow through the spray nozzles as long as desired. When this is no longer required, upon pushing the knob in, or upon shutting off the water, the spring will again urge the valve into closed position to permit normal flow through the faucet. O-rings are provided at 29 to seal attachment to the faucet, at 34 to seal the connection between conduit 32 and sleeve 20, and at 35 to seal the valve shaft 18. As shown "O" ring 31 is seated against a contoured area of chamber 28 to form a seat with the valve in closed position. The opposite side of chamber 28 is similarlly contoured to form a seat with "O" ring 31 when the valve is open and the "O" ring is received against such seat during water flow into channel 28*d*.

The nozzles are designed to provide a "soft" spray which will be of suitable height and texture so as to permit the spray to properly wash the eyes and face area. This is preferably accomplished by incorporating a disc 36 as shown in FIG. 5, between a retaining ring 37 of plastic or the like and a washer 38, near the base of the nozzle as shown in FIG. 3. In order to obtain optimum distribution of the water to form the spray the disc is provided with closely spaced alternate small and larger diameter holes 39 and 40 arranged annularly in a ring substantially equidistant between the center and circumference of the disc as shown in FIG. 5*a*. For a given water pressure and nozzle diameter the number, spacing and diameter of the holes may be determined experimentally. For a nozzle and disc diameter of about 0.8–0.9 in. for the nozzle and about 0.7–0.8 in. for the disc and water pressure of 30 lbs. to the nozzle the disc is preferably formed with 8 larger holes having a diameter of about 0.05 in. and 8 smaller holes having a diameter of about 0.01 in. Screen 41 positioned at the nozzle exit serves to further distribute the spray and protect the interior of the nozzle against debris and damage. The disc may be sheet metal or plastic but generally brass or stainless steel is preferred. Under these conditions a desirable soft water spray having a spray height of 8"–12" is obtained which is found suitable for emergency face and eye wash situations.

The valve body and tubular attachments may be made of steel, brass, aluminum, zinc or suitable plastics, but preferably of stainless steel or chromium plated brass. As described above, this device with its two piece construction provides various advantages such as the ability to attach and utilize the eye wash arrangement only when and for so long as needed to remove it for cleaning or otherwise. In addition, the provisions of a bypass conduit as a component of the faucet attachment permits such conduit to be used for the attachment of other devices or other types of nozzles if desired.

Other embodiments of the device as described above may be apparent to those skilled in the art without departing from the spirit and scope of my invention.

We claim:

1. An eye wash fountain for attachment to a water supply means which comprises a valve body having a water inlet channel and a water outlet channel permitting normal water flow through said channels, a chamber between said channels, a water conduit connected to said chamber, a valve member positioned within said chamber which in closed position prevents water flow to said conduit and which in open position diverts water from said inlet channel to said conduit while preventing water flow to said outlet channel, a sleeve member closed at one end and open at the other end and, having a pair of tubes, each tube having a wash nozzle attached thereto, each of said tubes being attached to and communicating with the interior of said sleeve member adjacent to said closed end, said sleeve member being removably attached to and communicating said conduit on said valve body.

2. An eye wash fountain according to claim 1 wherein said conduit on said valve body extends outwardly therefrom and wherein said sleeve member is dimensioned to fit snugly thereover in engagement with a sealing member therebetween, and means for locking said sleeve member with said tubes attached thereto having a locking means thereon in engagement with said conduit.

3. An eyewash fountain according to claim 1 wherein said valve member positioned between said inlet and outlet channels is provided with a stem surrounded by an open spring which normally urges a valve member having a sealing means thereon into engagement with a valve seat formed in said chamber between said inlet and outlet channels and wherein said stem is provided with a pull knob which permits said valve stem to be pulled against said spring to open communication between inlet channel and said conduit and into engagement with a valve seat formed at the opposite side of said chamber and thereby permitting said valve to divert water flow into said conduit while preventing water flow into said outlet channel by means of water pressure against said valve during water flow.

4. An eyewash fountain according to claim 1 wherein each of said nozzles is provided with a spray modifying members in the form of a perforated disc positioned adjacent to the base of the nozzle.

5. An eyewash fountain according to claim 4 wherein the perforations in the disc adjacent the base of the nozzles are a plurality of closely spaced alternate larger and smaller holes positioned annularly substantially equidistant between the center and circumference of the disc.

* * * * *